US011355074B2

(12) United States Patent
Heber et al.

(10) Patent No.: US 11,355,074 B2
(45) Date of Patent: Jun. 7, 2022

(54) METHOD AND ASSEMBLY FOR CHECKING THE OPERATING MODE OF A SCREEN

(71) Applicant: siOPTICA GmbH, Jena (DE)

(72) Inventors: André Heber, Weimar (DE); Ambrose Peter Nari, Jena (DE); Markus Klippstein, Jena (DE); Uwe Schroeter, Dornburg-Camburg (DE)

(73) Assignee: siOPTICA GmbH, Jena (DE)

( * ) Notice: Subject to any disclaimer, the term of this patent is extended or adjusted under 35 U.S.C. 154(b) by 0 days.

(21) Appl. No.: 17/055,395

(22) PCT Filed: Jun. 3, 2019

(86) PCT No.: PCT/EP2019/064298

§ 371 (c)(1),
(2) Date: Nov. 13, 2020

(87) PCT Pub. No.: WO2019/233930

PCT Pub. Date: Dec. 12, 2019

(65) Prior Publication Data

US 2021/0150995 A1 May 20, 2021

(30) Foreign Application Priority Data

Jun. 4, 2018 (DE) ..... 102018004485.9

(51) Int. Cl.
*G09G 3/34* (2006.01)
*G09G 5/10* (2006.01)

(52) U.S. Cl.
CPC ..... *G09G 3/3413* (2013.01); *G09G 5/10* (2013.01); *G09G 2320/066* (2013.01);
(Continued)

(58) Field of Classification Search
None
See application file for complete search history.

(56) References Cited

U.S. PATENT DOCUMENTS 7,393,128 B2 7/2008 Sakai et al.
9,881,531 B2 1/2018 Klippstein et al.
(Continued)

FOREIGN PATENT DOCUMENTS

DE 10 2006 023 694 A1 11/2006
WO WO 2015/121398 A1 8/2015
WO WO 2017/097975 A1 6/2017

*Primary Examiner* — Chad M Dicke
(74) *Attorney, Agent, or Firm* — Christensen, Fonder, Dardi & Herbert PLLC

(57) ABSTRACT

A method for checking an operating mode of a display screen switchable between a free-viewing operating mode B1 and a restricted-viewing operating mode B2, comprising: in operating mode B2, determining a brightness value H of a surface and/or edge of a transparent light guide; then, depending on the brightness value H: i) unchanged use of operating mode B2 if the brightness value lies within a range of specified Hg values; ii) switching off operating mode B2 if the brightness value lies within a range of specified Hs values; or iii) changed use of operating mode B2 if the brightness value lies within a range of specified Hm values, with the control unit exerting an influence on the image content perceptible on the display screen by reducing the latter's brightness and/or contrast, with the range Hm lying between the ranges Hs and Hg, and with the ranges bordering on each other.

9 Claims, 1 Drawing Sheet

(52) U.S. Cl.
CPC ..... *G09G 2320/068* (2013.01); *G09G 2320/0626* (2013.01); *G09G 2360/145* (2013.01)

(56) References Cited

U.S. PATENT DOCUMENTS

| | | | | |
|---|---|---|---|---|
| 10,310,302 | B2 | 6/2019 | Klippstein et al. | |
| 2006/0262530 | A1 | 11/2006 | Sakai et al. | |
| 2010/0134525 | A1 | 6/2010 | Nanbu | |
| 2010/0225640 | A1 | 9/2010 | Vieri et al. | |
| 2014/0002428 | A1 | 1/2014 | Letourneur et al. | |
| 2017/0069236 | A1 | 3/2017 | Klippstein et al. | |
| 2017/0263208 | A1 | 9/2017 | Imai et al. | |
| 2019/0004346 | A1* | 1/2019 | Klippstein | G02B 5/0242 |
| 2020/0341305 | A1* | 10/2020 | Woodgate | G02F 1/133536 |

* cited by examiner

METHOD AND ASSEMBLY FOR CHECKING THE OPERATING MODE OF A SCREEN

PRIORITY CLAIM

The present application is a National Phase entry of PCT Application No. PCT/EP2019/064298, filed Jun. 3, 2019, which claims priority from German Patent Application 10 2018 004 485.9, filed Jun. 4, 2018, the disclosures of which are hereby incorporated by reference herein in their entirety.

BACKGROUND OF THE INVENTION

In WO 2015/121398 A1, the applicant describes a display screen for a free and a restricted viewing mode, wherein a light guide for the restricted viewing mode must not receive light from lateral light sources. A disadvantage therein is that in case of component failures, say, of LEDs or electronic control circuitry, the privacy mode cannot be checked automatically, i.e., without operator.

In WO 2017/097975 A1, the applicant describes a display screen for a free and a restricted viewing mode, wherein a light guide for the restricted viewing mode receives light from lateral light sources. It is inherent to this technology, too, that in case of component failures, say, of LEDs or electronic control circuitry, the privacy mode cannot be checked automatically, i.e., without operator.

This and other methods known in display screen of prior art have the disadvantage that the existence of the privacy mode cannot be readily verified. In case of transaction-relevant systems such as, e.g., automatic telling machines or payment terminals, such verification is a must.

US 2010/0134525 A1 describes a display screen with a control device that detects the failure of a CCFL tube in the backlight and accordingly puts the display screen into a service mode, which enables at least a restricted use of the display screen even in case of a failure of the components mentioned above. The teaching of this publication, though, is not suited to characterizing the privacy quality of a display screen offering especially two operating modes for a free and a restricted viewing mode. Further, transmissive display screen using backlights based on CCFL tubes absolutely must have light-forming elements such as prism rasters and diffusors, since otherwise they cannot guarantee homogeneous image illumination US 2010/0225640 A1 describes the use of various modes of an LCD display. The teaching of this publication, too, is not suited to characterizing the privacy quality of a display screen that especially offers two operating modes for a free and a restricted viewing mode.

SUMMARY OF THE INVENTION

Departing therefrom, a problem of the invention is to disclose a method and an arrangement for checking the quality of the operating mode of a display screen that can be operated in at least two operating modes, viz B1 for a free viewing mode and B2 for a restricted viewing mode. The invention is intended not to need any user or operator to be present for checking, to occupy little space, and not to require any structural elements or components outside the volume of the respective display screen.

According to the invention, this problem is solved by a method for checking an operating mode B2 of a display screen with a control unit that can switch over the display screen between two operating modes, viz B1 for a free viewing mode and B2 for a restricted viewing mode, wherein switching on the operating mode B2 comprises the switching on of the light sources if the light sources in operating mode B1 are off, and comprises the switching off of the light sources if in operating mode B1 they are on, and wherein the light generated by the light sources is fed into a transparent light guide, the method comprising the following steps at a selectable point in time after the switching on of operating mode B2:

A) Determining the brightness value H at least at one point P of at least one surface and/or edge of the transparent light guide.

B) Prompting one of the following steps by the control unit depending on the brightness value H determined:

i) Unchanged use of operating mode B2 of the display screen if the brightness value H is within a range of specified Hg values, ii) switching off the operating mode B2 of the display screen if the brightness value H is within a range of specified Hs values, or iii) changed use of operating mode B2 of the display screen if the brightness value H is within a range of specified Hm values, with the control unit exerting an influence on the image content perceptible on the display screen by a reduction of the brightness or contrast of the display screen, optionally to an extent depending on the brightness value H, with the range Hm being arranged between the ranges Hs and Hg.

The ranges Hg, Hm and Hs, therefore, cover different brightness ranges, two of which at a time being complementary, which may, or may not, border on each other. In case the light sources are switched off when operating mode B2 is switched on, the brightness values in range Hg are smaller than those of range Hs and, thus, smaller also than the brightness values of range Hm, as this lies between the two ranges mentioned before. In case the light sources are switched on when operating mode B2 is switched on, things are just the reverse, i.e., then the brightness values in range Hg are greater than those in range Hs. Range Hg defines a so-called required value range; i.e. if the brightness values H come to lie in in this required value range, no changes need to be made.

The brightness value H is determined, then, in order to achieve, within the scope of the further steps of the method, a qualitative assessment of the quality of operating mode B2; on the basis of that quality, then, influence will be exerted on the further use of operating mode B2.

Here, the brightness value H is preferably measured by means of a light-sensitive sensor, preferably a photodiode.

Normally, the brightness value is measured in terms of illuminance—in lx—or also in terms of luminous flux or some other photometric quantity, and converted accordingly.

Alternatively, the at least one light-sensitive sensor can correspond to at least one light source—or parts thereof, if several light sources are intended—, which for this purpose is operated in a light-sensitive mode. This is possible with, e.g., an LED. For example, if several LEDs are provided, part of these LEDs could, for the duration of determining the brightness value H, even serve as light-sensitive sensors, while the other LEDs would continue to emit light.

If in step ii) switching off of the operating mode B2 of the display screen should be performed when the brightness value H lies within a range of specified Hs values, this may either mean that the display screen is switched over to the operating mode B1 or switched off completely, or switched over to a further operating mode that does not correspond to operating mode B2.

If in step iii) the changed use of operating mode B2 of the display screen is activated, i.e. if the brightness value H lies within a range of specified Hm values, the control unit exerts an influence on the image content perceptible on the display screen. This may take place, for example, by the brightness and/or the contrast being changed directly in the image content, e.g. by a change of the bitmap values to lower values or values with smaller absolute differences, respectively. Alternatively, the brightness of the backlight of a display screen can be reduced, so that the physical display screen brightness is diminished.

Optionally, the brightness and/or the contrast of the image content perceptible on the display screen be diminished to a degree depending on the brightness value H. In accordance with the manner of switching over between operating modes B1 and B2, this may mean that, with higher or alternatively lower values H within the range Hm, the brightness and/or the contrast will be diminished in a higher or lower degree, respectively.

In a way, by virtue of the invention, the brightness value H specifies a maximum brightness or a maximum contrast of the content perceptible on the display screen, within the framework of which in operating mode B2 sufficient privacy of viewing is achieved.

In a first embodiment of an appropriate display screen, the appropriate light sources for the operating mode B2, which are decisive for switching between the operating modes, are off. An exemplary configuration for such a display screen can be derived from WO 2015/121398 A1, the disclosure of which is expressly included herewith. That document describes a display screen for a free and a restricted viewing mode, wherein the said light guide for the restricted viewing mode B2 must not receive light from lateral light sources. Accordingly, the range of Hg values will contain low brightness values only, which take into account a tolerance resulting from imaging light and ambient light captured in the light guide.

Here, then, between a viewer of the display screen and the said light guide, no light-forming layers—such as, e.g., customary BEF, DBEF, diffusor foils, etc.—are arranged except a transmissive image generator (numbered 5 in the WO 2015/121398 A1 publication). At most, a touch-sensitive layer and/or protective layers such as, e.g., a glass coverslip may be arranged on the image generator.

In a second embodiment of the display screen, the light sources are on for the operating mode B2. An exemplary configuration for such a display screen can be derived from WO 2017/097975 A1, the disclosure of which is expressly included herewith. This document describes a display screen for a free and a restricted viewing mode, wherein the appropriate light guide for the restricted viewing mode B2—the light guide that is decisive for switching between the operating modes—must receive light from lateral light sources, in contrast to the first embodiment mentioned above. Accordingly, the range of Hg values will represent a range of minimum brightness values, because too low a brightness value H would mean that not enough light for achieving the privacy effect is coupled into the respective light guide.

Here, then, between a viewer of the display screen and the said light guide, no light-forming layers—such as, e.g., customary BEF, DBEF, diffusor foils, etc.—are arranged on the image generator, except perhaps a touch-sensitive layer and/or protective layers such as, e.g., a glass coverslip.

The invented method gains particular importance in an embodiment wherein, after operating mode B2 has been switched on, step A) is, at two or more defined points in time T1, T2, . . . , executed at least twice in succession for determining brightness values H1, H2, . . . , wherein preferably the light sources, at the defined points in time T1, T2, . . . emit defined light intensity values L1, L2, . . . that preferably differ from each other.

Further, in this case, all brightness values H1, H2, . . . are compared with ranges of specified values Hg1, Hg2, . . . , and operating mode B2 will continue to be used without any changes only if brightness values H1, H2, . . . lie within the respective ranges of specified values Hg1, Hg2, . . . .

For this purpose, e.g., a PWM (pulse width modulation) signal, modulated in time in a defined manner, can be applied to the light sources as a test signal, in order to check whether the electronic control circuitry has been manipulated, or whether all original components are still present in the arrangement without being tampered with. Only if the test signal is proved to lie within the ranges of specified values Hg1, Hg2, . . . the arrangement is free of any manipulation.

Where appropriate, the PWM signal modulated in time in a defined manner can also be varied in time: it is possible, e.g., to apply and check a different PWM signal every day or every week.

Alternatively, in this embodiment, it is possible for the light sources to emit light intensity values L1, L2, . . . at a time interval, e.g., of a few seconds—preferably very short, i.e. 0.05 s—, in order to verify the visual mode B2 recurrently, e.g., during the use of an automatic teller machine.

In this embodiment, all brightness values H1, H2, . . . should profitably be compared with the ranges of specified values Hg1, Hg2, . . . . Then, the operating mode B2 is reliably present only if all brightness values H1, H2, . . . lie within the respective ranges of specified values Hg1, Hg2, . . . .

Further embodiments allow for the ranges of specified values Hg or, if provided, Hg1, Hg2, . . . , to be dynamically variable so as to be adaptable to different brightnesses of the display screen.

The control unit can, e.g., implemented by software and/or electronic circuitry.

The problem of the invention is also solved by a method for checking a mode of operation of a display screen that can be operated in two operating modes, viz B1 for a free viewing mode and B2 for a restricted viewing mode, wherein a switching over between the operating modes B1 and B2 comprises at least the switching on of light sources (2) if the light sources (2) are off in operating mode B1, and the switching off of the light sources (2) if they are on in operating mode B1, and wherein the light generated by the light sources is fed into a transparent light guide, the method comprising the following steps at a selectable point in time after the switching on or off, respectively, of the light sources (2):

A) Determining a brightness value H at least at one point P of at least one surface and/or edge of the transparent light guide by means of at least one light-sensitive sensor, wherein the said light-sensitive sensor corresponds to at least one light source, which, for this purpose, is operated as a light-sensitive sensor in a light-sensitive mode only for the duration of determining the brightness value H, B) Comparison of the brightness value H with a range of Hg values, wherein the operating mode B1 is active if the brightness value H lies outside the said range Hg, and wherein the operating mode B2 is active if the brightness value H lies within the said range of specified values S.

Here, the configurations described above apply analogously.

Moreover, the problem of the invention is also solved by an arrangement, comprising

- a display screen that can be operated in two operating modes, viz B1 for a free viewing mode and B2 for a restricted viewing mode, with light sources the light of which is fed into a transparent light guide, with switching on of operating mode B2 comprising at least switching on of the light sources (2) if these are off in operating mode B1, and comprising switching off of the light sources (2) if they are on in operating mode B1,
- a control unit that can switch over the display screen between the two operating modes B1 and B2,
- means for determining the brightness value H at least at one point P of at least one surface and/or edge of the transparent light guide, if the display screen works in operating mode B2,
- with the control unit being configured in such a way that it can cause one of the following steps depending on the determined brightness value H:
  - a) Unchanged use of operating mode B2 of the display screen, if the brightness value H lies within a range of specified Hg values,
  - b) switching the operating mode B2 of the display screen off if the brightness value H lies within a range of specified Hs values,
  - c) changed use of operating mode B2 of the display screen, if the brightness value H lies within a range of specified Hm values, with the control unit exerting an influence on the image content perceptible on the display screen by reducing the brightness and/or contrast of the latter—optionally in a degree depending on the brightness value H,
  - with the range of Hm values lying between the Hs and Hg ranges, and the ranges bordering on one another.

The said means to determine the brightness value H can comprise at least one light-sensitive sensor, e.g., a photodiode. The arrangement can be operated analogously to the embodiments of the invented method. The display screen may also correspond to a static image.

The invented method and the invented arrangement can be employed to advantage in a device for handling payment-relevant processes and/or for cash depositing or withdrawal, or in a vehicle, with the said use in operating mode B2 being admitted only if the determined brightness values H lie in a predefined range Hg or Hm in operating mode B2.

Within certain limits, variations of the parameters described above will, in principle, not detract from the inventive ingenuity.

It is to be understood that the features mentioned before and explained below are applicable not only in the combinations stated but also in other combinations or as standalone features without leaving the scope of the present invention.

BRIEF DESCRIPTION OF THE DRAWINGS

Below, the invention will be explained in more detail with reference to accompanying drawings, which also show features essential to the invention, and in which.

The drawings are not to scale and represent principles only.

DETAILED DESCRIPTION OF THE DRAWINGS

Figure 1:
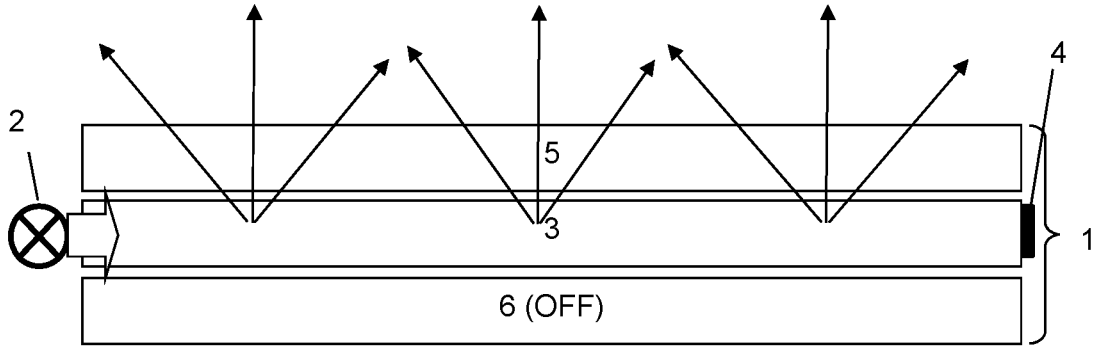
FIG. 1 is a sketch illustrating the principle of the invented method applied to a display screen with a light guide arranged (in the viewing direction) behind a backlit image generator, with the display screen being operated in the free viewing mode B1.

FIG. 1 is a sketch illustrating the principle of the invented method applied to a display screen 1 with a light guide 3 arranged (in the viewing direction) behind a backlit image generator 5, with light sources 2 for the lateral coupling in of light, with the display screen 1 being operated in the free viewing mode B1. An exemplary first embodiment of such a display screen 1 or a backlight 6 switchable between two operating modes B1 and B2 can be derived in further details of the applicant's WO 2015/121398 A1. Other embodiments are also possible, of course.

For the free viewing mode B1, the—directed—backlight 6 is switched off, whereas the light sources 2 are switched on, which feed light into the light guide 3, which, being decisive for switching between the operating modes B1 and B2, radiates the light by means of an image generator 5, e.g., an LCD panel, into a wide viewing space. At least one light-sensitive sensor 4, e.g., a photodiode, is then arranged at that edge of light guide 3 which is positioned opposite the coupling-in edge of the light guide 3 for the light sources 2, in order to detect a brightness value H at least at one point P of the light guide 3. Naturally, several light-sensitive sensors 4 can be provided as well.

On account of the coupling of light from the light sources 2 into the light guide 3, which in operating mode B1 is desired, the determined value H will more likely be high here, possibly amounting to several hundred thousands or millions $lm/m^2$ (equivalent to the quantity lx). Such a value would result, e.g., if 40 LEDs were each coupling 40 lm of light into a light guide 3 having a length of 120 mm, with the light guide being 2 mm thick, and with about 90% of the light being coupled out of the light guide 3 on account of outcoupling structures, while about 10% of the light coupled in will exit the light guide 3 at the edge situated opposite to the coupling-in side of the light guide 3.

Thus, in operating mode B1, the (assumedly) determined value H mentioned above, amounting to several 100,000 lx, lies outside the ranges Hg and Hm; it will rather be found in range Hs. If such high values actually occurred in operating mode B2, the electronic control circuitry would switch the operating mode B2 off, which would be the case, e.g., due to an erratic behavior of the display screen 1, for instance if the display screen 1, when in operating mode B1, has failed to react to a command to switch over to operating mode B2.

Figure 2:
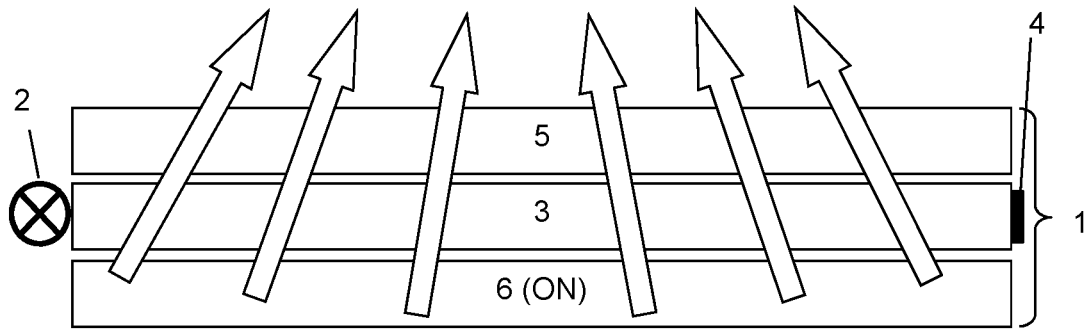
FIG. 2 is a sketch illustrating the principle of the invented method applied to a display screen with a light guide arranged (in the viewing direction) behind a backlit image generator, with the display screen being operated in the restricted viewing mode B2.

Contrary to this, FIG. 2 is a sketch illustrating the principle of the invented method applied to a display screen 1 with a light guide 3 arranged (in the viewing direction) behind a backlit image generator 5, with the display screen 1 being operated in the restricted viewing mode B2. The structure is thus the same as described above for FIG. 2, with the difference that, now, the light sources 2 are switched off, whereas the directed backlight 6 is switched on. Because of the directed backlight 6 and the transparent light guide 3, the restricted viewing mode B2 is reached. This, however, applies only if the least possible light is radiated by light guide 3 into a wide angle.

Here, the invented method for checking an operating mode B2 of a display screen 1 with a control unit that can switch the display screen 1 between two operating modes, viz B1 for a free viewing mode and B2 for a restricted viewing mode—with the switching on of operating mode B2 comprising the switching on of the light sources 2 if in operating mode B1 the light sources 2 are off, and comprising the switching off of the light sources 2 if in operating mode B1 the light sources 2 are on, and wherein the light generated by the light sources 2 is fed into a transparent light guide 3—comprises the following steps executed at a selectable point in time after operating mode B2 has been switched on:

A) Determining the brightness value H at least at one point P of at least one surface and/or edge of the transparent light guide 3, B) Prompting one of the following steps by the control unit, depending on the brightness value H determined:

i) Unchanged use of operating mode B2 of the display screen 1, if the brightness value H lies within a range of specified Hg values, ii) switching the operating mode B2 of the display screen 1 off, if the brightness value H lies within a range of specified Hs values, iii) changed use of operating mode B2 of the display screen 1, if the brightness value H lies within a range of specified Hm values, wherein the control unit exerts an influence on the image content perceptible on the display screen 1 by reducing its brightness and/or contrast, optionally in a degree depending on the brightness value, with the range Hm lying between the ranges Hs and Hg, and the ranges bordering on each other.

At least one light-sensitive sensor 4, e.g., a photodiode, is then arranged at that edge of the light guide 3 which is positioned opposite to the coupling-in edge of the light guide 3 for the light sources 2, in order to detect the brightness value H at least at one point P of the light guide 3.

In this embodiment, an exemplary range of Hg values for the operating mode B2 will comprise low values, e.g., values smaller than 1.000 lx, as otherwise too much light from the light guide 3 is radiated in wide angles by means of the image generator 5. Here, an exemplary range Hm would comprise values between 1,000 lx and 10,000 lx. The closer the determined brightness value H is to the upper limit of the range Hm, the further down, in step iii), will the control unit reduce the brightness and/or the contrast of the image represented on the display screen 1. In the example described, the range Hs comprises brightness values greater than 10,000 lx.

Figure 3:
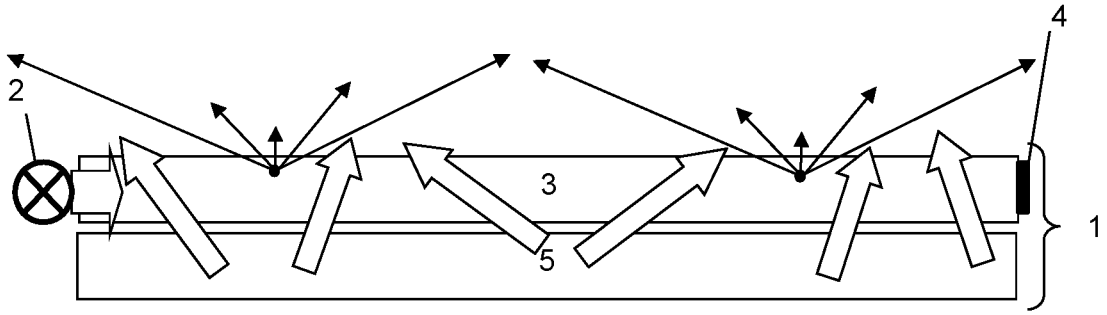
FIG. 3 is a sketch illustrating the principle of the invented method applied to a display screen with a light guide arranged (in the viewing direction) in front of an image generator, with the display screen being operated in the restricted viewing mode B2.
Figure 4:
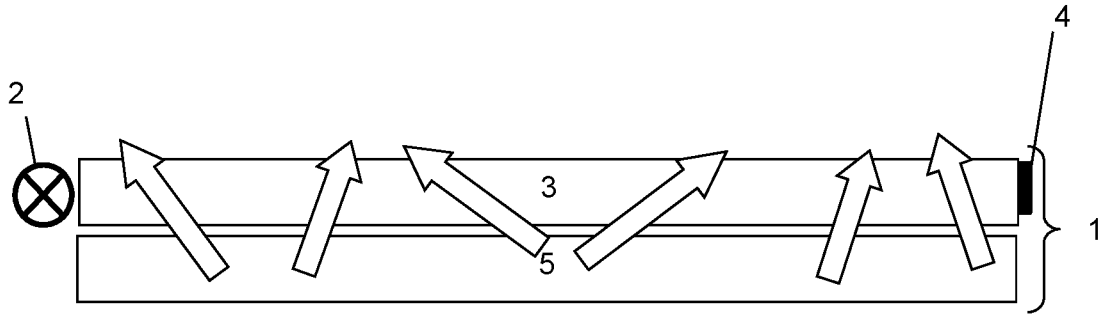
FIG. 4 is a sketch illustrating the principle of the invented method applied to a display screen with a light guide arranged (in the viewing direction) in front of an image generator, with the display screen being operated in the free viewing mode B1.

In a second embodiment of the display screen 1, which is illustrated in FIGS. 3 and 4, the light sources 2 are on for operating mode B2. An exemplary configuration for such a display screen 1 can be derived from WO 2017/097975 A1. This publication describes a display screen for a free and a restricted viewing mode wherein a light guide 3 for the restricted viewing mode receives light from lateral light sources. The light then is radiated from the light guide 3 primarily sideways, but not toward the front, so as to outshine the image sideways, whereas it is still perceptible from the front. Thus, protection against unwanted viewing, i.e., the operating mode B2 can be generated. FIG. 3 illustrates the principle of the invented method, applied to a display screen 1, with a light guide 3 arranged (in viewing direction) in front of an image generator 5, with the display screen 1 being operated in the restricted viewing mode B2. Here again, at least one light-sensitive sensor 4, e.g., a photodiode, is arranged at that edge of the light guide 3 which lies opposite to the coupling-in edge of the light guide 3 for the light sources 2, in order to detect the brightness value H at least at one point P of the light guide 3.

According to the invention, now first the light sources 2 are switched on, the light of which is fed into a transparent light guide 3 in order to activate operating mode B2. Subsequently, the following steps are carried out:

A) Determining the brightness value H at least at one point P of at least one surface and/or edge of the transparent light guide 3.

B) Prompting one of the following steps by the control unit, depending on the brightness value H determined:

i) Unchanged use of operating mode B2 of the display screen 1, if the brightness value H lies within a range of specified Hg values ii) switching the operating mode B2 of the display screen 1 off, if the brightness value H lies within a range of specified Hs values, iii) changed use of operating mode B2 of the display screen 1, if the brightness value H lies within a range of specified Hm values, wherein the control unit 1 exerts an influence on the image content perceptible on the display screen 1 by reducing its brightness and/or contrast, optionally in a degree depending on the brightness value.

Here, the range of Hg values for the operating mode B2 will more likely comprise high values, e.g., with a lower limit of one hundred thousand lx or higher, or, alternatively, even of one or several million lx, because otherwise not enough light would be radiated from the light guide 3 above the image generator 5 into lateral angles (radiation into the frontal direction should be avoided, though) and, thus, the viewing restriction would be brought about in lateral directions due to cross fading. On account of the coupling of light from the light sources 2 into the light guide 3—which is desired for the operating mode B2—here the value H, in the configuration shown in FIG. 3 with the light sources 2 switched on, will actually lie in this range, provided that the light sources 2 are operating correctly; the value H may amount, e.g., to 500,000 lx (or, in the alternative case, 2,500,000 lx). It will thus lie within the range Hg suggested for this second embodiment, and the operating mode B2 will be used unchanged.

In this case, the range Hm can comprise values between 70,000 lx and up to 100,000 lx. Therefore, according to the invention, the control unit would, in step iii), influence the image content displayed.

The control unit would switch the operating mode B2 off only in case the determined brightness value H were located in range Hs, comprising values smaller than 70.000 lx.

FIG. 4 is a sketch illustrating the invented method, applied to a display screen 1 with a light guide 3 arranged (in viewing direction) in front of an image generator 5, with the display screen 1 being operated in the free viewing mode B1. As the light sources 2 are switched off here, the sensor 4 determines a low value H, e.g., 500 lx or 2,000 lx, which results from residual light tolerances due to light captured by light guide 3. The light captured originates from the ambient light and from the image represented on the display screen 1, among other causes. Thus, H lies in range Hs, and the operating mode B2 cannot be used or is not available, respectively.

As described above, the values specified for the brightness value H and the ranges Hg, Hm, Hs are examples only. Other values and ranges are possible, of course.

Further embodiments are designed to allow dynamic variations of the ranges Hg, Hm, Hs or, if existing, the ranges Hg1, Hm1, Hs1, Hg2, Hm2, Hs2, . . . , for adaptation to different brightnesses of the display screen 1.

As the above explanation of the invented method can be applied analogically to the invented arrangement, it is not repeated here for redundancy reasons.

The display screen 1 may also correspond to a static image in some cases.

The invented method and the invented arrangement can be used to advantage in a device for handling payment-relevant processes and/or for cash depositing or withdrawal, or in a vehicle.

The display screen described above solves the problem of the invention: The above description covers a method and an arrangement for checking the quality of the operating mode of a display screen that can be operated in at least two operating modes, viz B1 for a free viewing mode and B2 for a restricted viewing mode, without the need of a user or operator being on the spot. Further, the invention occupies little space and needs no structural elements or components outside the volume of the respective display screen.

What is claimed is:

1. A method for checking an operating mode B2 of a display screen with a control unit for switching over the display screen between two operating modes, viz B1 for a free viewing mode and B2 for a restricted viewing mode, wherein the switching on of the operating mode B2 comprises the switching on of light sources if they are off in operating mode B1, and the switching off of the light sources if they are on in operating mode B1, and wherein the light generated by the light sources is fed into a transparent light guide, wherein for operating mode B1 the light guide radiates the light into a wide viewing space and for operating mode B2, when operating mode B2 comprises a switching off of light sources, the light guide minimizes a radiation of light into a wide angle and, when operating mode B2 comprises a switching on of light sources, light from the light guide is radiated sideways, but not in a frontal direction, so as to outshine the image sideways, the method comprising the following steps at a selectable point in time after the operating mode B2 has been switched on:

A) Determining the brightness value H at least at one point P of at least one surface and/or edge of the transparent light guide, B) Prompting one of the following steps by the control unit, depending on the brightness value H determined:

i) Unchanged use of the operating mode B2 of the display screen if the brightness value H lies within a range of specified Hg values, where Hg defines a required value range for which the quality of operating mode B2 is sufficient, so that no influence needs to be exerted, ii) switching the operating mode B2 of the display screen off if the brightness value H lies within a range of specified Hs values, where Hs defines a value range for which the quality of operating mode B2 is not sufficient, so operating mode B2 cannot be used or is not available, or iii) changed use of the operating mode B2 of the display screen if the brightness value H lies within a range of specified Hm values, wherein the control unit exerts an influence on the image content perceptible on the display screen by reducing its brightness and/or its contrast, with the range Hm lying between the ranges Hs and Hg, and the ranges bordering on each other.

2. The method as claimed in claim 1, wherein said brightness value H is measured by at least one light-sensitive sensor, preferably a photodiode.

3. The method as claimed in claim 2, wherein the at least one light-sensitive sensor corresponds to at least one light source or parts thereof, which is operated in a light-sensitive mode.

4. The method as claimed in claim 1, wherein the step A) is, at least at two defined points in time T1, T2, . . . after the step i), carried out at least twice in succession for the determining of brightness values H1, H2, . . . , wherein preferably the light sources (2), at the defined points in time T1, T2, . . . , radiate defined light intensity values L1, L2, . . . , which preferably differ from each other.

5. The method as claimed in claim 4, wherein all brightness values H1, H2, . . . are compared with ranges of specified values Hg1, Hg2, . . . , and the operating mode B2 continues to be used only when all brightness values H1, H2, . . . lie within the respective ranges of specified values Hg1, Hg2, . . . .

6. The method as claimed in claim 1, wherein the brightness and/or contrast of the display screen are reduced in a degree depending on the brightness value H.

7. A method for checking an operating mode of a display screen that can be operated in two operating modes, viz B1 for a free viewing mode, and B2 for a restricted viewing mode, wherein a switching over between the operating modes B1 and B2 comprises at least the switching on of light sources if they are off in operating mode B1, and comprises the switching off of the light sources if they are on in operating mode B1, and wherein the light generated by the light sources is fed into a transparent light guide, wherein for operating mode B1 the light guide radiates the light into a wide viewing space and for operating mode B2, when operating mode B2 comprises a switching off of light sources, the light guide minimizes a radiation of light into a wide angle and, when operating mode B2 comprises a switching on of light sources, light from the light guide is radiated sideways, but not in a frontal direction, so as to outshine the image sideways, the method comprising the following steps at a selectable point in time after the light sources have been switched on or off, respectively:

A) Determining a brightness value H at least at one point P of at least one surface and/or edge of the transparent light guide by means of at least one light-sensitive sensor, wherein the said light-sensitive sensor corresponds to at least one light source, which, for this purpose, is operated as a light-sensitive sensor in a light sensitive mode, only for the duration of determining the brightness value H, B) Comparison of the brightness value H with a range of Hg values, wherein the operating mode B1 is active if the brightness value H lies outside the said range Hg, where the quality of operating mode B2 is not sufficient, so operating mode B2 cannot be used or is not available, and wherein the operating mode B2 is active if the brightness value H lies within the said range Hg, where the quality of operating mode B2 is sufficient, so that no influence needs to be exerted.

8. An arrangement comprising:

a display screen that can be operated in two operating modes, viz B1 for a free viewing mode and B2 for a restricted viewing mode, with light sources the light of which is fed into a transparent light guide, with the switching on of the operating mode B2 comprising at least the switching on of the light sources if they are off in the operating mode B1, and comprising the switching off of the light sources if they are on in the operating mode B1, wherein for operating mode B1 the light guide radiates the light into a wide viewing space and for operating mode B2, when operating mode B2 comprises a switching off of light sources, the light guide minimizes a radiation of light into a wide angle and, when operating mode B2 comprises a switching on of light sources, light from the light guide is radiated sideways, but not in a frontal direction, so as to outshine the image sideways, a control unit that can switch over the display screen between the two operating modes B1 and B2, means for determining the brightness value H at least at one point P of at least one surface and/or edge of the transparent light guide, if the display screen is operating in operating mode B2, the control unit being configured in such a way that it can prompt one of the following steps depending on the brightness value H determined:

i) Unchanged use of operating mode B2 of the display screen, if the brightness value H lies within a range of specified Hg values, where Hg defines a required value range for which the quality of operating mode B2 is sufficient, so that no influence needs to be exerted, ii) switching off the operating mode B2 of the display screen, if the brightness value H lies within a range of specified Hs values, where Hs defines a value range for which the quality of operating mode B2 is not sufficient, so operating mode B2 cannot be used or is not available, or iii) changed use of operating mode B2 of the display screen, if the brightness value H lies within a range of specified Hm values, wherein the control unit exerts an influence on the image content perceptible on the display screen by reducing its brightness and/or contrast, with the range Hm lying between the ranges Hs and Hg, and the ranges bordering on each other.

9. Use of arrangement as claimed in claim 8, in a device for handling payment-relevant processes and/or for cash depositing or withdrawal, or in a vehicle, with the said use in operating mode B2 being admitted only if the determined brightness values H in operating mode B2 lie in a predefined range Hg or Hm.

* * * * *